US008904566B2

(12) United States Patent
Clark

(10) Patent No.: US 8,904,566 B2
(45) Date of Patent: Dec. 9, 2014

(54) RECONFIGURABLE MITTENS HAND COVERINGS

(71) Applicant: Theresa Clark, Leonard, MI (US)

(72) Inventor: Theresa Clark, Leonard, MI (US)

( * ) Notice: Subject to any disclaimer, the term of this patent is extended or adjusted under 35 U.S.C. 154(b) by 0 days.

(21) Appl. No.: 14/033,575

(22) Filed: Sep. 23, 2013

(65) Prior Publication Data

US 2014/0082825 A1 Mar. 27, 2014

Related U.S. Application Data

(60) Provisional application No. 61/703,949, filed on Sep. 21, 2012.

(51) Int. Cl.
*A41D 19/01* (2006.01)
*A41D 19/00* (2006.01)

(52) U.S. Cl.
CPC ..... *A41D 19/01* (2013.01); *A41D 19/0017* (2013.01)
USPC ..... 2/158; 2/169

(58) Field of Classification Search
CPC . A41D 19/0013; A41D 19/0017; A41D 19/01
USPC ..... 2/158, 169, 269, 270, 159, 160, 161.6, 2/163, 123, 125
See application file for complete search history.

(56) References Cited

U.S. PATENT DOCUMENTS

| | | | | | |
|---|---|---|---|---|---|
| 1,092,047 | A * | 3/1914 | Hertz | 2/270 |
| 1,113,870 | A * | 10/1914 | Billings | 2/158 |
| 1,275,837 | A * | 8/1918 | Biggs | 2/158 |
| 2,274,335 | A * | 2/1942 | Kennedy | 2/158 |
| 2,274,510 | A * | 2/1942 | Wohl et al. | 2/270 |
| 2,315,889 | A * | 4/1943 | Wells | 2/158 |
| 4,651,350 | A * | 3/1987 | Dawiedczyk | 2/158 |
| 4,756,027 | A * | 7/1988 | Buenos et al. | 2/123 |
| 5,125,117 | A | 6/1992 | Buenos et al. | |
| 5,815,837 | A * | 10/1998 | Christman et al. | 2/158 |
| 6,839,911 | B1 | 1/2005 | Mathews | |
| 7,290,291 | B2 * | 11/2007 | Anderson et al. | 2/159 |
| D652,609 | S * | 1/2012 | Walker | D2/621 |
| 2012/0311766 | A1 * | 12/2012 | Clark | 2/158 |

* cited by examiner

*Primary Examiner* — Amy Vanatta
(74) *Attorney, Agent, or Firm* — John R. Benefiel

(57) ABSTRACT

A mitten hand covering which can be reconfigured from a closed end condition covering the fingers and thumb to a condition where the fingers and thumb may be protruded through openings to be exposed for improved dexterity. The hand covering is made from a sheet of material folded up and sewn along perimeter edges of an auxiliary section and sub-section of a main section of a pattern formed by the sheet.

8 Claims, 5 Drawing Sheets

RECONFIGURABLE MITTENS HAND COVERINGS

CROSS REFERENCE TO RELATED APPLICATIONS

This application claims the benefit of U.S. provisional application No. 61/703,949 filed on Sep. 21, 2012.

BACKGROUND OF THE INVENTION

The present invention concerns hand coverings such as mittens which in one configuration can completely cover the fingers and thumb of a wearer, but can be changed to another configuration in which the fingers and/or the thumb can be exposed in order to improve the wearer's dexterity while wearing the hand covering.

A mitten having an attached partial cuff is shown in U.S. Pat. No. 5,125,117, which attached partial cuff can be turned inside out to alternatively close off the end of the mitten or to open the mitten end so that the fingers are exposed.

Similarly reconfigurable foot and head coverings are also shown in that patent.

The partial cuff comprises a sewn-on fabric panel covering approximately one half of the circumference of the main covering portion of the mitten.

Other patents show various convertible hand coverings allowing exposure of the fingers for added dexterity when desired.

Such hand coverings typically utilize added pieces of fabric which are bulky or that necessitate removal of the added piece, requiring storage of the same. Such hand coverings do not allow for separate exposure of the thumb.

SUMMARY OF THE INVENTION

It is an object of the present invention to provide reconfigurable a hand covering which integrates a cuff with the rest of the hand covering such as to not require attachment of a separate piece and to minimize the bulk of the hand covering, and which also selectively allows exposure of the wearer's thumb.

The above object is achieved by a hand covering made from a pattern cut from a sheet of fabric material folded up and sewn so as to form a hand covering having an external cuff of minimum bulk which can be turned inside out to either close off or to leave open the end of the hand covering to either cover or expose the fingers. A thumb pocket is also formed allowing either covering of the thumb when it is inserted in the thumb pocket or exposure of the thumb by insertion of the thumb through an opening adjacent the thumb pocket.

The hand covering includes two finger pockets into which the wearer can alternatively insert his other fingers, a first one formed by folding up an auxiliary section of the pattern over the upper end of subsection of a main section. The auxiliary section and upper end of the one subsection each have a thumb outline portion on one side which form a combined finger pocket and thumb pocket when the section and subsection end are folded atop each other and sewn together.

The auxiliary section is folded over the subsection end along a fold line which connects the auxiliary section and one end of the one subsection, causing the same to overlie each other, with aligned border portions then stitched or otherwise connected together.

The other subsection of the main section is then folded over the one subsection along a transversely extending fold line separating the two subsections, with the one section overlain by the other subsection, which also overlies the sewn together auxiliary section and the end of the one subsection.

The aligned perimeter portions of the two folded together overlying subsections opposite the transverse fold line are then stitched or otherwise connected together, but leaving an unsewn gap along the open base of the thumb pocket.

The hand covering so formed is then turned inside out to create a reconfigurable mitten hand covering having an integrally formed external partial cuff.

In a first embodiment, when the wearer's hand is inserted between the sewn together subsections, the fingers can protrude through the open end of the sewn together subsections, and the thumb protruded through the unsewn gap located along the aligned border portions extending along the edges of the folded together subsections.

The angled out thumb pocket and the finger pocket are positioned on either the front or the back of the wearer's hand depending on whether it is worn on the right or left hand. The partial cuff formed by the finger and thumb pocket can be rolled over to the other side of the wearer's hand, covering the fingers, and the thumb pushed into the thumb pocket to cover the wearer's thumb and fingers.

In a second embodiment, the two subsections are arranged end to end to extend away from each other and folded together along a transverse fold line so as to form a closed end finger pocket. The auxiliary section is located on one side of the end of one of the subsections so that when the auxiliary section is folded over the upper end of the one subsection, an open ended finger pocket is formed after the completed hand covering is turned inside out.

The material used in the pattern can be created by sewing together different fabric pieces having contrasting colors, textures, etc. or on reverse sides to expose a different look of the different sewn together parts when the cuff is turned inside out.

Two mitten hand coverings both of a configuration as described above can be partially sewn together at their open ends. This will serve two purposes, i.e., one of the mittens can be pulled up the arm as an arm warmer, leaving the other mitten in position on the hand, with an unsewn part of the circumferential sewn together ends of the mittens at the wrist allowing viewing of a watch/GPS worn by the user.

The two sewn together mitten hand coverings can also be worn together on the same hand, with one mitten comprising an inner liner for the other mitten. The inner mitten is configured to cover the thumb and fingers which protrude from the outer mitten, when the mitten is configured to expose the fingers and thumb, which are covered by the liner.

The pocket of the outer mitten may be turned inside out and rolled over in the process to cover the fingers and thumb to provide a double layer for maximum warmth of the fingers and thumb.

By pulling back the end and thumb of outer mitten, the pocket of the inner mitten can be reached to allow it to be rolled over to expose the fingers and thumb, completely uncovered by either mitten.

A hand covering according to the invention can also be partially sewn to an end of an arm warmer sleeve, with the other end sewn to a shirt garment.

A separate arm warmer sleeve can also be provided having the mitten as an integral part thereof.

Also, the convertible hand covering according to the invention can be incorporated as a part of the sleeve of an outer garment.

DETAILED DESCRIPTION

Figure 1:
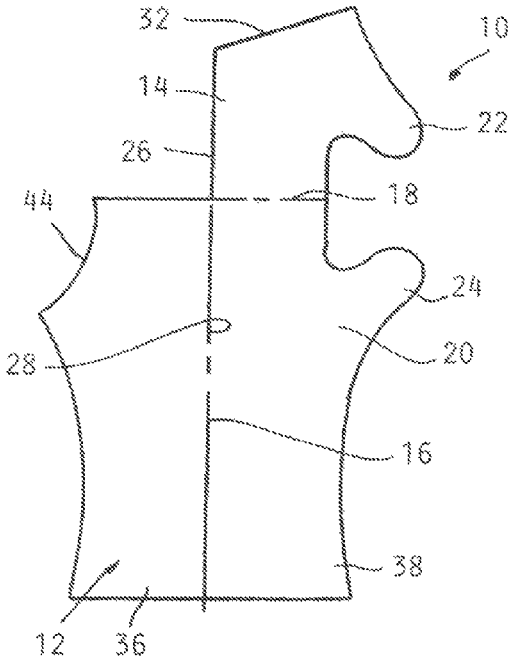
FIG. 1 is a plan view of a fabric pattern for forming a reconfigurable hand covering according to the present invention.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to the drawings and in particular FIGS. 1-4, a pattern 10 is cut from fabric material in a first step, the pattern 10 forming a main section 12 divided into two subsections 36, 38, connected by an intermediate fold line 16 lying between the two subsections 36, 38. An auxiliary section 14 extends from one end of one subsection 38, a transverse intermediate fold line 18 joining it to the one end of one of the two subsections 36, 38 of the main section 12 of the fabric pattern 10.

Figure 2:
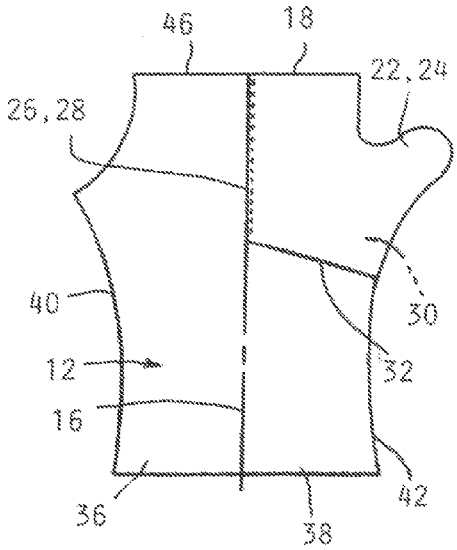
FIG. 2 is a plan view of the pattern shown in FIG. 1 but with an auxiliary section folded over and stitched to one end of one of two subsections of the main section of the pattern to form one of the finger pockets.

In a second step, auxiliary section 14 is folded down along the intermediate fold line 18, as seen in FIG. 2, to overlie the top end 20 of one subsection 38 of the main section 12. The auxiliary section 14 and upper end 20 have matching shapes so as to overlie and have aligned border portions with each other when the auxiliary section 14 is folded down along fold line 18. Respective thumb contours 22, 24 are formed on respective aligned section 14 and subsection end 20 as well as straight sides 26, 28 on the opposite sides as seen in FIG. 2. The straight sides 26, 28 are sewn together to form a closed end pocket 30 after aligned portions of the thumb contours 22, 24 are also partially sewn together to form seams 21, 23, 25 in the next step as seen in FIG. 3.

An open entrance thereto is provided by the angled unsewn edge 32 of the auxiliary section 44, which extends across the bottom of the pocket 30 at a location intermediate right hand subsection 38 of the main section 12.

Figure 3:
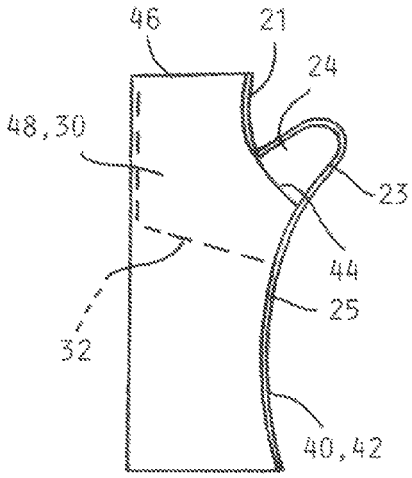
FIG. 3 is a plan view of the pattern as shown in FIG. 2 but with subsections of a main section of the pattern folded and stitched together along aligned portions of their perimeter to form another finger pocket and complete the reconfigurable mitten hand covering, leaving a gap at a thumb pocket to allow the wearer's thumb to be poked through the gap to expose the thumb of the wearer in one configuration of the hand covering.

The next step involves folding the main section 12 in two by folding the left side section 36 along a fold line 16 transverse to the first mentioned fold line 18 over the right side section 38 and over the folded down and sewn auxiliary section 14, which was folded over along the fold line 18, as seen in FIG. 3.

The respective sides 40 and 42 of the left and right subsections 36, 38 of the main section 12 have border portions which become aligned with each other, with the exception of the thumb contour 24 of the right side 38. The left side has a curved edge 44 which cuts across the base of the thumb contour 34.

The aligned border portions 40, 42 of the left and right subsections 36, 38 are connected together as by being sewn together, except along the part of the curved edge 44 which crosses the thumb contours 22, 24 which is left unsewn to create an opening to allow the thumb of the wearer to be pushed out of the hand covering 10. This forms a generally tubular piece configured to be able to receive and be fit to the wearer's hand inserted into the open lower end thereof.

The sewing together of the border portions 40, 42 also creates another finger pocket 48 which is open ended since the upper edge 46 of the left section 36 is not sewn to the folded over edge 18.

Figure 4:
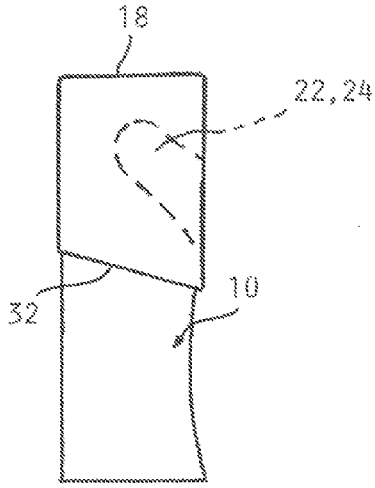
FIG. 4 is a plan view showing the completed hand coverings turned outside-in and on the hand of a wearer.

The completed mitten hand covering 10 as seen in FIG. 3 is inside out and must be turned outside-in to be in its normal ready to wear condition as seen in FIG. 4.

Figure 5:
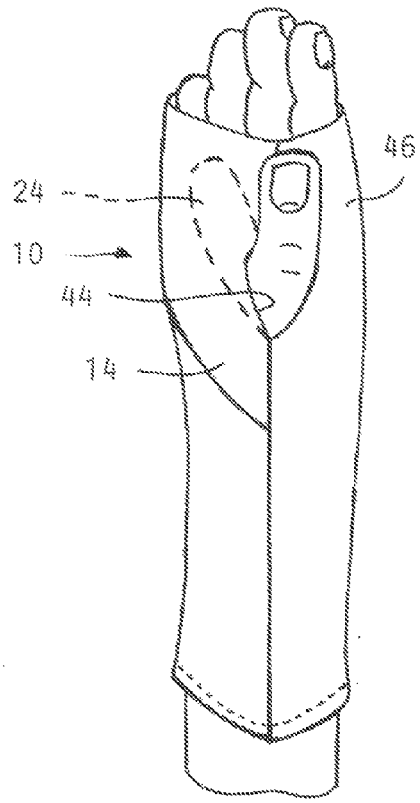
FIG. 5 is a pictorial view of the mitten hand covering in the exposed finger and thumb configuration on the right hand of a wearer.

Thus, the fingers of a wearer will protrude out the open end of pocket 48 and the thumb will protrude out through the hole created by the unsewn portion 44 of the aligned border portions seen in FIG. 5, the thumb pocket 24 tucked inside the pocket 48.

The auxiliary section 14 and forms a cuff which is outside the pocket 48 extends across the now outer side of the back of the end 20 of the right side section 38 as worn on the right hand as seen in FIG. 4.

Figure 7:
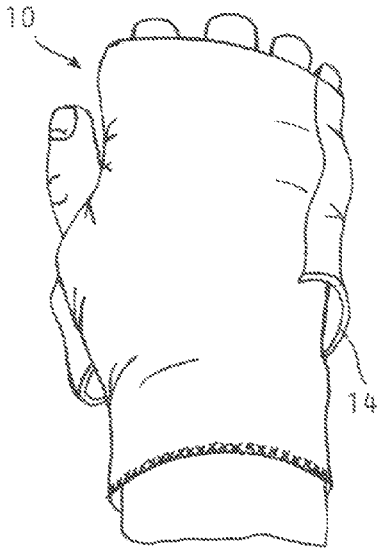
FIG. 7 is a reverse pictorial view of the mitten hand covering shown in FIG. 5.

When worn on the right hand as seen in FIG. 7, the cuff formed by the auxiliary section 14 will be on the palm of the wearer. When worn on the left hand, the auxiliary section will be on the back of the hand which is most often desired for minimal bulk on the palm when the hand covering 10 is worn in the fingerless configuration. This is the preferred configuration when built into a shirt or jacket.

Figure 6:
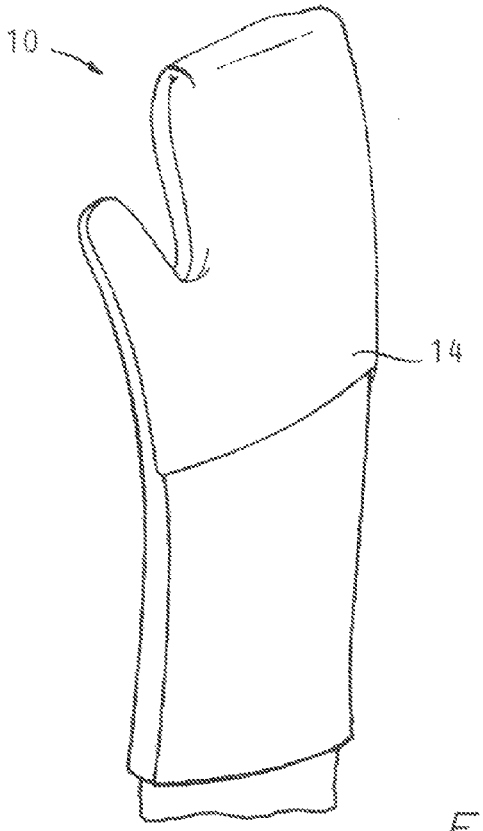
FIG. 6 is a pictorial view of the mitten hand covering in the finger and thumb covered configuration on the hand of a wearer.
Figure 8:
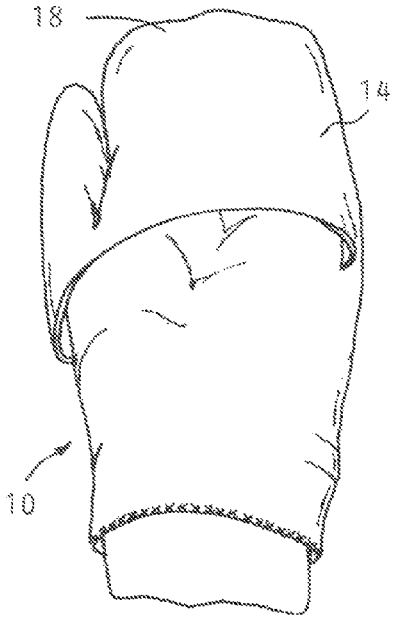
FIG. 8 is a reverse pictorial view of the mitten hand covering shown in FIG. 6.

When the auxiliary section 14 is rolled over the end of the mitten hand covering 10, the end of the pocket 48 is covered by fold line 18 and the thumb pocket 24 will enclose the wearer's thumb as seen in FIGS. 6 and 8 to cover the fingers and thumb.

Figure 1A:
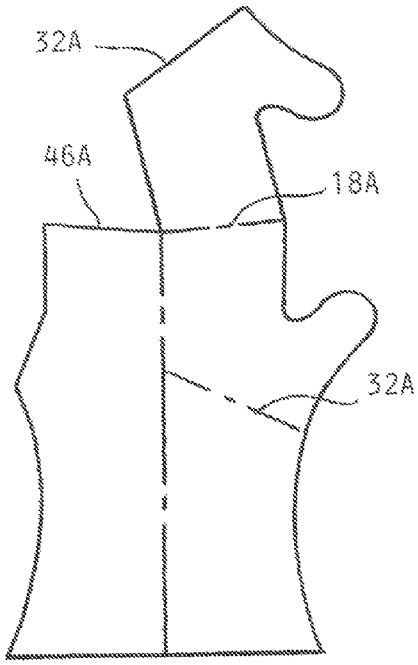
FIG. 1A is a plan view of an alternate pattern configuration.

As seen in FIG. 1A, the fold line 18A can be angled to be a better fit to the contour defined by the wearer's finger tips.

Also, instead of using a single piece of fabric, separate pieces can be sewn together to form the pattern.

Figure 9:
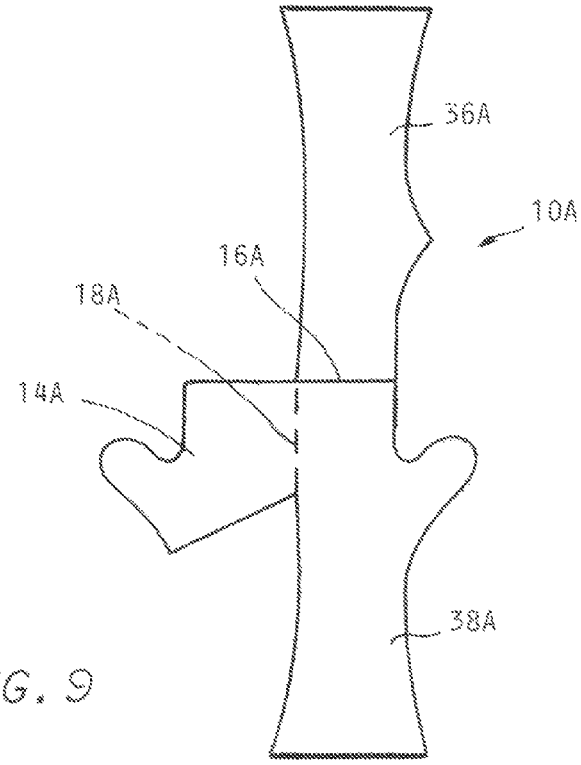
FIG. 9 shows an alternative pattern for forming the mitten hand covering.

Finally, it is noted that, as seen in FIG. 9, the positions of the auxiliary section 14A and left side subsection 36A and main section 12 can be switched, i.e. auxiliary section 14 may protrude to the free side of the right side subsection 38A at the upper end. The fold lines 18A and 16A extend in switched directions, i.e. fold line 16A extends across the mitten hand covering 10A and fold line 18 extends longitudinally. This will still produce open and closed end finger pockets 30A and 48A.

Figure 10:
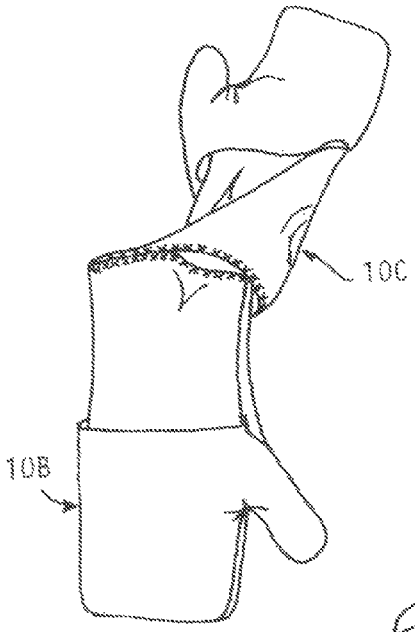
FIG. 10 is a pictorial view of a pair of two reconfigurable mitten hand coverings partially sewn together end to end.
Figure 11:
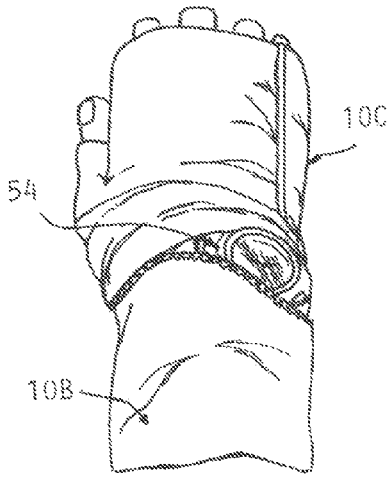
FIG. 11 is a pictorial view of the two mitten hand coverings of FIG. 10 being worn with one hand covering used as an arm warmer.
Figure 12:
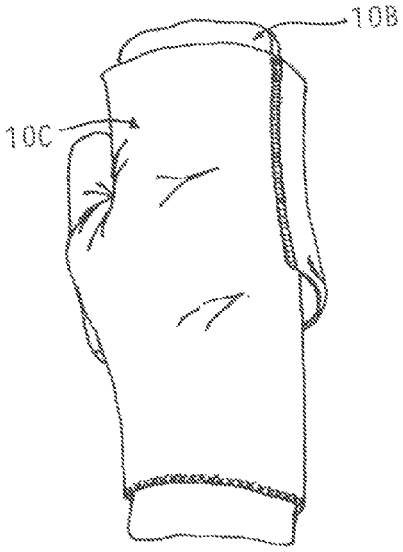
FIG. 12 is a pictorial view of the mitten hand coverings of FIG. 10 with one of the mitten hand coverings worn as a liner of the other mitten hand covering.

As shown in FIGS. 10 and 11, two mitten hand coverings 10B, 10C according to the invention can be connected together with the sleeve ends sewn to each other, leaving an unsewn gap 54 allowing a watch to be viewed therethrough.

One of the mitten hand coverings 10B can be used as a warming sleeve as seen in FIG. 11 with the end in the uncovered open state allowing the arm of the wearer to be reviewed therein.

Alternatively, one of the mitten hand coverings shown as 10B can be adjusted.

Figure 13:
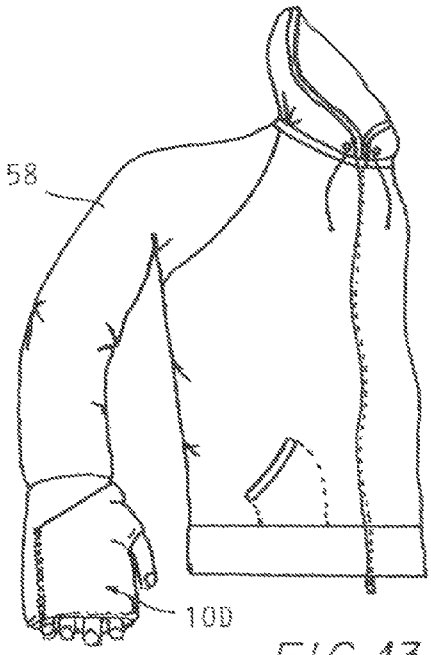
FIG. 13 is a pictorial view of a mitten hand covering according to the invention comprised of a sleeve attachment to an outerwear garment on the hand and forearm of a wearer.

As seen in FIG. 13, a mitten hand covering 10D can be sewn to the sleeve of an outerwear garment 58 or may be incorporated into a single piece of fabric as a glove/sleeve attached at the shoulder in a manner defined by overall garment design.

It should be understood that contrasting fabric textures, weaves, and colors can be used for the various sections thereof to create colorful effects as desired.

The invention claimed is:

1. A mitten hand covering reconfigurable to either completely cover the fingers and the thumb of a wearer or alternatively to allow exposure of the ends of the fingers and thumb of a wearer for added dexterity of a wearer, comprising:

a main section of material having two elongated subsections folded together substantially in two along an intermediate lengthwise extending fold line joining the two subsections with the aligned perimeter portions of the two subsections joined together to form a generally tubular piece open at at least one end to be able to receive and be fitted to the hand of a wearer inserted into said open end;

an auxiliary section of material connected on one side thereof to an upper end of one of said two subsections and folded back over said upper end of said one of said subsections along an intermediate fold line transverse to said fold line joining said two subsections; said auxiliary section and said end of said one subsection each formed with a thumb shaped portion aligned with each other and sewn together along the aligned perimeter portions of said thumb shaped portions thereof;

a first and second overlying finger and thumb pockets at said other end of said tubular piece, a first one of said pair of pockets defined by said auxiliary section of material folded over and sewn to said upper end of said one subsection and a second one of said first and second of pockets formed by overlying upper ends of said folded together subsections, one of said finger pockets closed off at an end thereof by one of said intermediate fold lines to enable covering of a wearer's finger tips by insertion of said finger tips into said pocket and the finger portion of said the other pocket open ended to enable exposure of the fingers of a wearer for improved dexterity, said other subsection perimeter portion extending across said thumb shaped portion which perimeter is not joined to said subsection to create an opening which allows the wearer's thumb to be passed out through said opening to expose the wearer's thumb for added dexterity.

2. The mitten hand covering according to claim 1 wherein said two subsections are arranged end to end with respect to each other at opposite longitudinal ends with said connecting fold line extending across the length of said joined end to end subsections at an intermediate location thereon.

3. The mitten hand covering according to claim 1 wherein said two subsections are joined to each other side by side along a lengthwise side of each subsection thereof with said connecting fold line extending parallel to the length of said tubular piece.

4. The mitten hand covering according to claim 1 wherein said fold line associated with said auxiliary section extends at an angle to said lengthwise direction to create an angled closed end of said pocket formed by said auxiliary section and said one end of said one section.

5. A method of making a mitten hand covering which may be alternatively configured to cover the fingers of a wearer or to allow exposure of the fingers comprising cutting a piece of material into a pattern comprised of a main section having a length sufficient to be able to enclose the fingers, hand and wrist of the wearer, said main section having two lengthwise extending subsections and also an auxiliary section projecting from the end of one of the subsections, said subsections each of a length able to cover the fingers and hand of a wearer;

folding the auxiliary section over said one end of one of the subsections along a fold line connecting said auxiliary section to said one end of said one subsection so as to overlap the same with aligned perimeter portions thereof;

attaching at least part of said aligned perimeter portions together to form a first finger pocket defined between said auxiliary section and said one end of said one subsection;

folding said subsections together along a second fold line dividing said main section into said two subsections so as to overlap and align said perimeter portions thereof; and attaching at least part of said aligned perimeter portions together to define a second finger pocket defined by said overlapped one end of said one subsection and one end of the other subsection; and turning said folded and attached subsections and auxiliary section inside out; and whereby one of said first or second finger pockets have a closed end defined by said first or second fold lines and the other of said first or second pockets is open at the end to allow the fingers to protrude therethrough when the hand covering is put on by a wearer.

6. The method according to claim 5 wherein said subsections are arranged to be side by side with respect to each other and the auxiliary section extends from said one end of one of said subsections and is folded over said end of said one end a lengthwise direction, whereby said finger pocket formed thereby has a closed end.

7. The method according to claim 5 wherein said subsections are arranged end to end to each other and said auxiliary section extends to one side of said one end of said one subsection and is folded crosswise over said one end of said one subsection and the other of said subsections is folded in a lengthwise direction over said one subsection and said folded over auxiliary section thereby forming said closed end pocket.

8. The method according to claim 5 wherein said auxiliary section and said one end of said one subsection are each formed with a matching thumb contour projection which overlie each other when said auxiliary section is folded over said one end of one subsection to form part of said aligned perimeter portions, and a separate thumb pocket, and wherein said other of said subsections has a perimeter edge which cuts across the thumb contour portions when folded over said one subsection which is unattached thereto to create an opening through which a wearer's thumb can protrude when the wearer's fingers are in said open ended pocket.

* * * * *